United States Patent [19]

Knight

[11] 4,386,972

[45] Jun. 7, 1983

[54] METHOD OF HEAT TREATING FERROUS METAL ARTICLES UNDER CONTROLLED FURNACE ATMOSPHERES

[75] Inventor: David G. Knight, Chesterfield, England

[73] Assignee: Air Products and Chemicals, Inc., Allentown, Pa.

[21] Appl. No.: 243,230

[22] Filed: Mar. 13, 1981

Related U.S. Application Data

[63] Continuation of Ser. No. 750,132, Dec. 13, 1976, abandoned, which is a continuation-in-part of Ser. No. 517,062, Oct. 22, 1974, abandoned.

[30] Foreign Application Priority Data

Oct. 26, 1973 [GB] United Kingdom ..... 49963/73

[51] Int. Cl.[3] ..... C21D 1/48

[52] U.S. Cl. ..... 148/16; 148/16.5; 148/16.6; 148/16.7

[58] Field of Search ..... 148/16, 16.5, 16.6, 148/16.7, 20.3, 12.1

[56] References Cited

U.S. PATENT DOCUMENTS

| | | | |
|---|---|---|---|
| 1,975,541 | 9/1934 | Osterman | 148/16.5 |
| 3,413,161 | 11/1968 | Goehring | 148/16.5 |
| 3,620,518 | 11/1971 | Winter et al. | 148/16 |
| 3,663,315 | 5/1972 | Hoffman et al. | 148/16.5 |
| 3,705,058 | 12/1972 | Koloxsuari et al. | 148/16.6 |
| 3,748,195 | 7/1973 | Kondo et al. | 148/16.5 |
| 3,950,192 | 4/1976 | Golland et al. | 148/16.5 |
| 4,035,203 | 7/1977 | L'Hermite et al. | 148/16.5 |
| 4,049,472 | 9/1977 | Arndt | 148/16 |

FOREIGN PATENT DOCUMENTS

| | | | |
|---|---|---|---|
| 816051 | 7/1959 | United Kingdom | 148/16.5 |
| 1039906 | 8/1966 | United Kingdom | 148/16.5 |
| 1042612 | 9/1966 | United Kingdom | 148/16.5 |
| 1126246 | 9/1968 | United Kingdom | 148/16.5 |

OTHER PUBLICATIONS

Holcraft, "Nitrogen . . . Carrier . . . in Carburizing", Metals Progress, Feb. 1948, pp. 2–7.

Titox, "Controlled Atmospheres . . . From . . . Nitrogen & Natural Gas", Met. Term. OB Metalloy, Sep. 1964, pp. 26–31.

Mouflard, "Care Hardening Atmospheres . . . Methanol", Rev. Met. 38, May 1961, pp. 401–405.

Arnold, "Ways to Gas Alloying", Iron & Steel Engr., Aug. 1960, pp. 91–107.

Perry, "Develop. in Controlled Atmospheres", Met. Treating Conference, Birmingham, Jun. 1965, pp. 1–19.

Collin, "Math. Model . . . Carbon Conc . . . in Carburized Steel", Journal Iron and Steel Inst., Oct. 1972, pp. 785–789.

Metals Handbook, vol. 2, 1964, pp. 94, 95, 98, 99, 105, 106 and 122–124.

*Primary Examiner*—John P. Sheehan

*Attorney, Agent, or Firm*—James C. Simmons; E. Eugene Innis

[57] ABSTRACT

Method of generating furnace atmospheres and processes for using the atmospheres for carburizing, decarburizing, neutral hardening, annealing or carbonitriding ferrous base metals.

The invention is characterized by forming atmospheres that are a mixture of an oxygen-bearing medium comprising oxygen or a gaseous compound containing oxygen in combination with hydrogen and carbon, a gaseous source of hydrocarbon and an inert gas carrier forming the major component of the mixture. Gaseous ammonia can be substituted for a portion of the inert gas carrier to provide an atmosphere suitable for carbonitriding ferrous base metals.

The normally gaseous mixture is prepared outside of the furnace and then injected into the furnace where reaction of the mixture produces the desired furnace atmosphere.

3 Claims, 1 Drawing Figure

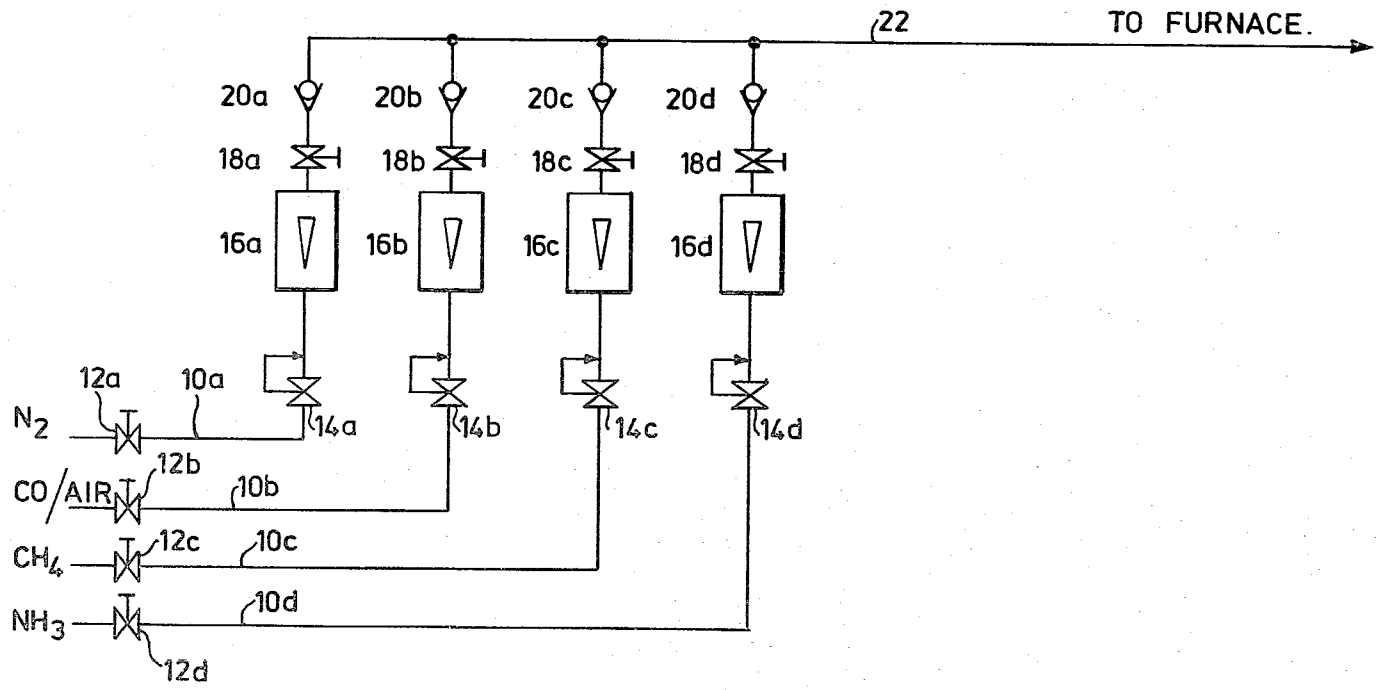
TO FURNACE.
22
20a
20b
20c
20d
18a
18b
18c
18d
16a
16b
16c
16d
14a
14b
14c
14d
10a
10b
10c
10d
12a
12b
12c
12d
N2
CO/AIR
CH4
NH3

METHOD OF HEAT TREATING FERROUS METAL ARTICLES UNDER CONTROLLED FURNACE ATMOSPHERES

CROSS-REFERENCE TO RELATED APPLICATION

This application is a continuation of application Ser. No. 750,132, Filed Dec. 13, 1976 which is a continuation-in-part of application Ser. No. 517,062 filed Oct. 22, 1974 both abandoned.

BACKGROUND OF THE INVENTION

1. Field of the Invention

The invention pertains to the field of metallurgical heat treating, and in particular, to the heat treating of ferrous metal articles under controlled atmospheres. Ferrous metal articles, and in particular, the conventional grades of steel being denoted by grade according to American Iron and Steel Institute (AISI) nomenclature contain carbon. As these articles are raised to elevated temperature for thermal treatment, e.g. hardening, annealing, normalizing and stress relieving, under an ambient furnace atmosphere containing air, hydrogen, water vapor, carbon dioxide, and other chemical compounds the surface of the article will become reactive. It is well-known that the presence of water vapor, hydrogen ($H_2$), and carbon dioxide ($CO_2$) in the furnace atmosphere will cause carbon at the surface of the ferrous metal article to react and thus be removed from the article. When the carbon is depleted from the surface of the article, the article no longer has a homogeneous cross section due to the change in chemistry and crystallography thus changing the physical properties such as surface hardness and strength of the finished article. In order to avoid this phenomenon, such articles are heated under a controlled atmosphere containing carbon which is available for reaction with the article being treated, or under an atmosphere that is essentially neutral (to either add a slight amount of carbon to the surface of the ferrous article being heated or prevent removal of carbon from the surface).

Under certain conditions it is desirable to add substantial but controlled amounts of carbon to the surface of the article to increase its surface hardness and wear resistance. This is normally accomplished by heating the article to an elevated temperature (in excess of 690° C.) in a controlled carbonaceous atmosphere that adds a desired percentage by weight of carbon to the surface of the article. In the same manner, if ammonia is added to the controlled carbonaceous atmosphere, nitrogen as well as carbon is added to the surface of the article to produce additional hardness and wear resistance of the surface of the article.

In certain manufacturing operations, it is desirable to remove controlled amounts of carbon from the surface of the article to achieve a predetermined lower percentage of carbon in the surface of the article. This is accomplished by heating the article to an elevated temperature in a controlled carbonaceous atmosphere that removes carbon from the surface of the article.

In its broad aspect then, the present invention pertains to heating ferrous metal articles under an atmosphere which is created to control the surface chemistry of the article being treated.

2. Description of the Prior Art

The prior art is adequately summarized in the section entitled "Furnace Atmospheres and Carbon Control" found at pages 67 through 92, and that portion of the section entitled "Case Hardening of Steel" appearing at pages 93 through 128 of volume 2 of the Metals Handbook published in 1964 by the American Society for Metals, Metals Park, Ohio. The particular volume of the Metals Handbook is referred to as Heat Treating, Cleaning and Finishing. All of the material set forth in the aforementioned sections of the Metals Handbook are incorporated herein by reference and will be referred to from time to time in the specification. In particular, that portion of the section on control of surface carbon content appearing on pages 90 through 91 of the Metals Handbook referred to above, and dealing with the determination of carbon potential of a furnace atmosphere is pertinent to the invention herein disclosed.

As set out in the Metals Handbook, furnace atmospheres such as involved in the instant invention, fall broadly into six groups. The first of these is a so called Exothermic Base Atmosphere which is formed by the partial or complete combustion of a fuel gas/air mixture. These mixtures may have the water vapor removed to produce a desired dew point in the atmosphere.

The second broad category is the Prepared Nitrogen Base Atmosphere which is an exothermic base with carbon dioxide and water vapor removed.

The third broad classification is Endothermic Base Gas Atmospheres. These are formed by partial reaction of a mixture of fuel gas and air in an externally heated catalyst filled chamber.

The fourth broad category is the Charcoal Base Atmosphere which is formed by passing air through a bed of incandescent charcoal.

The fifth broad category is generally designated as Exothermic-Endothermic Base Atmospheres. These atmospheres are formed by complete combustion of a mixture of fuel gas and air, removing water vapor, and reforming the carbon dioxide to carbon monoxide by means of reaction with fuel gas in an externally heated catalyst filled chamber.

The sixth broad category of prepared atmosphere is the Ammonia Base Atmosphere. This atmosphere can be raw ammonia, dissociated ammonia, or partially or completely combusted dissociated ammonia with a regulated dew point.

In-situ generation of carburizing atmosphere in the furnace by decomposition of a hydrocarbon liquid at elevated temperature, is disclosed in U.S. Pat. No. 2,056,175. U.S. Pat. No. 2,161,162 discloses in-situ creation of a carburizing atmosphere in the furnace and use of the spent furnace atmosphere as a carrier gas. U.S. Pat. No. 3,413,161 discloses creation of a carburizing atmosphere by in-situ combustion of a hydrocarbon fuel in the presence of less than stoichiometric amounts of air in the furnace. U.S. Pat. No. 3,620,518 discloses a furnace having a catalytic surface on the furnace walls to create a carburizing atmosphere by the reaction of a hydrocarbon such as butane or propane with air inside the furnace.

Other aspects of carburizing are disclosed in U.S. Pat. Nos. 2,287,651; 2,955,062; 3,356,541 (reissued as RE. 26,935) and U.S. Pat. No. 3,397,875.

U.S. Pat. No. 2,786,003 discloses a method of nitriding a chromium steel by spiking the furnace atmosphere with carbon monoxide to control the depth of nitriding, while U.S. Pat. No. 3,705,053 and U.S. Pat. No. 3,748,195 discloses conventional dissociated ammonia atmosphere nitriding processes wherein oxygen is added to the furnace atmosphere to provide a soft nitrided case. Other aspects of nitriding are disclosed in U.S. Pat. No. 3,892,597.

U.S. Pat. No. 3,519,257 discloses a process for in-situ catalytic generation of a nitriding or carbo-nitriding atmosphere while U.S. Pat. No. 3,663,315 discloses a method of inhibiting soot formation during carburizing. Lastly, U.S. Pat. No. 3,705,058 discloses a method of nitro-carburizing.

All of the foregoing are representative of the state of the art of protective furnace atmospheres, as well as furnace atmospheres for carburizing, decarburizing, carbonitriding or other carbon control in the surface of a ferrous metal article being heat treated.

SUMMARY OF THE INVENTION

The present invention is drawn to the use of gaseous compositions that are blended at ambient temperature and injected into a metallurgical furnace maintained at an elevated temperature (e.g. in excess of 690° C.), the furnace being used to provide a thermal treatment to a ferrous article while the article is maintained under a protective atmosphere. Specific processes are disclosed for performing carburizing, decarburizing, carbon restoration, carbonitriding annealing or neutral hardening of a ferrous article by a combination of the thermal history of the article being treated and control of the furnace atmosphere.

Broadly, the preferred processes employ atmosphere compositions consisting essentially of an inert gaseous carrier (e.g. nitrogen, helium, argon, krypton, etc.) to which is added a hydrocarbon gas (methane or higher paraffin), an oxygen bearing medium (oxygen, carbon dioxide, carbon monoxide, water vapor and mixtures thereof), and in the case of a carbonitriding atmosphere, ammonia. In order to effect the processes of the present invention, it has been discovered that the ratio of hydrocarbon to oxygen bearing medium must be controlled within specified limits. Observing the compositional and ratio limitations specified herein results in the effective processes disclosed and claimed.

In most of the prior art processes that find wide commercial acceptance, the atmospheres are generated externally of the furnace by use of an atmosphere generator wherein air and fuel gas are combusted to form an atmosphere or carrier gas which is then injected into the heat treating furnace. Most of the exothermic and endothermic atmospheres require auxiliary generators thus requiring a substantial capital expenditure for such equipment. One of the keys to the present invention is the simple blending of the gaseous components outside the furnace which are then injected into the furnace for reaction to achieve the desired process thus eliminating the need for an auxiliary generator.

Therefore, it is the primary object of this invention to provide improved atmosphere compositions for injecting into metallurgical treatment furnaces.

It is another object of this invention to provide atmosphere compositions and processes for carburizing ferrous metal articles.

It is yet another object of the present invention to provide an atmosphere composition and process for decarburizing ferrous metal articles.

It is a further object of the present invention to provide atmosphere compositions and processes for carbonitriding ferrous metal articles.

It is still another object of the present invention to provide atmosphere compositions and processes for neutral hardening ferrous metal articles.

Another object of the present invention is to provide processes for carbon restoration on the surface of decarburized ferrous metal articles using the atmosphere decompositions of the present invention.

BRIEF DESCRIPTION OF THE DRAWING

The single FIGURE of the drawing is a schematic diagram illustrating one method of preparing atmosphere compositions for delivery to a metallurgical treatment furnace.

DETAILED DESCRIPTION OF THE PREFERRED EMBODIMENT

There are three commonly used on-site generators for producing protective or controlled atmospheres in heat treatment of metals. These are: (1) Exothermic gas generators which, depending on the fuel gas/air ratio and the post partial combustion stage ancillary equipment, can produce gas atmospheres suitable as protection in many heat treatment applications for non-ferrous materials and ferrous materials containing low levels of alloying elements; (2) Endothermic gas generators, whose major area of application is in providing a carrier gas for controlled carbon processing of ferrous components; and (3) Ammonia dissociators, which provide a high fixed composition hydrogen containing gas suitable for annealing/reduction of high alloyed steels and materials or where a high level of reduction is required.

An endothermic generator requires a separate fuel supply for heating purposes and an electrical power supply for associated instrumentation. It is an expensive device which requires maintenance and occupies floor space. Further, such generators commonly have a specified rated output and this output is only adjustable within narrow limits. In practice, a bank of generators is used to supply gas atmosphere to a number of furnaces and when the gas atmosphere output exceeds requirements, for example when one furnace is shut down, rather than shut down one generator, which is considered uneconomical, the excess output is wasted.

One goal of this invention is to obviate the need for such generators, particularly endothermic generators, by synthesizing (blending) controlled atmospheres from bulk supplied, bulk stored or pipeline gases. This provides a totally flexible system by which it is possible to accurately regulate the supply of high purity gas atmospheres in accordance with varying requirements. In addition, capital, operating and maintenance costs are reduced and non-production time, for example, required for the regeneration of the endothermic generator catalyst, is minimized.

The atmosphere composition is blended from a source of commercially available nitrogen, a source of natural gas which is predominantly methane and which is commonly found in industrial plants as a pipeline natural gas, commercially available oxygen bearing medium (e.g. carbon dioxide) and in the case of carbonitriding, ammonia. These gases can be metered into the furnace directly through a blending panel thus eliminating the endothermic generator which is normally required for producing carburizing atmosphere gases.

The atmospheres, according to the present invention, have two properties heretofore not available with conventional atmospheres generated either using exothermic, endothermic or other conventional techniques. These are:

1. Carbon potential of the furnace atmosphere bears a direct relationship to the hydrocarbon to oxygen bearing medium ratio of the input blend. The input ratio relationship has been established at temperatures ranging from 690° C. to 1150° C. as will be disclosed hereinafter.
2. Carbon availability of the blend can be varied by adjusting the percentage of nitrogen as well as the hydrocarbon/oxygen bearing medium ratio. Carbon availability can be increased by decreasing the percentage of nitrogen and increasing the hydrocarbon/oxygen bearing medium ratio and vice versa. This will also be adequately demonstrated hereinafter.

According to the present invention, there is provided a method of heat treating ferrous metal in a furnace chamber which method comprises the steps of preparing a mixture comprising an oxygen bearing medium selected from the group consisting essentially of oxygen, air, carbon dioxide, carbon monoxide, water vapour and mixtures thereof; a hydrocarbon, the ratio of hydrocarbon to oxygen bearing medium being between 0.6 and 8.0; and an inert gas carrier; and delivering said mixture, each 100 gm. moles of which consists of between 1.36 and 8.2 gm. moles oxygen (either as gaseous oxygen or in the form of carbon dioxide, carbon monoxide, water vapour and mixtures thereof); between 60 and 95 gm. moles inert gas; and to 38.64 gm. atoms of carbon (the number of gm. atoms of carbon in the hydrocarbon being greater than the number of gm. moles of oxygen in the oxygen bearing medium) to said furnace chamber which is maintained at or above 690° C. and wherein the mixture reacts to form a carbon controlled atmosphere.

The inert gas carrier can comprise, for example, nitrogen, helium or argon. The inert gas will normally consist of the inert gas carrier except where the oxygen bearing medium is air, in which case the inert gas will consist of the inert gas carrier plus nitrogen from the air.

Where the inert gas carrier is nitrogen, each 100 gm. moles of the mixture preferably contains between 70 and 95 gm. moles of nitrogen and more preferably between 89 and 95 gm. moles of nitrogen.

The hydrocarbon can comprise, for example, methane or a higher paraffin. In this connection each 100 gm. moles of mixture preferably includes a trace to 19.4 moles of hydrocarbon containing 3.42 to 19.4 gm. atoms of carbon, and more preferably contains between a trace and 12.7 gm. moles of hydrocarbon containing 7.75 to 12.7 gm. moles of carbon.

Mixing of the components is preferably effected at a temperature equal to or less than ambient although, if desired, the mixture may be preheated before injection into the furnace chamber, to a temperature less than the temperature at which chemical interaction occurs between the components of the mixture.

The mixture is preferably chosen so that the carbon controlled atmosphere within the furnace contains between 3.9 and 10.7% (by volume) carbon monoxide and more preferably between 3.9 and 8.2% by volume carbon monoxide.

The heat treatment concerned may be carburizing, decarburizing, carbon restoration, neutral hardening, annealing or carbonitriding in which latter case ammonia is added to the mixture so that the ratio of ammonia to ammonia plus mixture is less than or equal to 1:5 (by volume).

In the context of the present invention, carburizing is taken to mean that process wherein carbon is added to the surface of a ferrous metal article in order to increase the carbon content at the surface thus producing a case of higher carbon, or to restore carbon to the surface of the article so that the carbon content is homogeneous throughout the cross section of the ferrous metal article. In carbon restoration, what is sought is to replace the carbon that may have been depleted in previous heating operations which were not conducted under atmosphere control. Conventional carburizing techniques are well known as amply discussed in the prior art set out above.

Decarburizing is taken to mean that process of removing carbon from the surface of a ferrous metal article or from the entire cross section of a ferrous metal article, if the section permits, for the purposes of subsequent treatment, fabrication or use in other manufacturing processes.

Neutral hardening is taken to mean that process under which ferrous metal articles are heated to an elevated temperature for cooling to produce a hardened structure in the cross section. The atmosphere is selected so that carbon is neither added nor depleted from the surface of the article except that in some instances, slight decarburization (e.g. one or two thousandths of an inch) is acceptable.

Carbonitriding is taken to mean that process wherein nitrogen, as well as carbon, is transferred from the atmosphere into the surface of the ferrous metal article. In this context it must be remembered that ferritic nitrocarburizing and austenitic carbonitriding are separate and distinct technologies, and that the teachings of one technology are in no way applicable to the teachings of the other. In particular, ferritic nitro-carburizing is a process in which the surface of the metal undergoing treatment reacts chemically with nitrogen in the nitrocarburizing mixture to produce a chemical compound. On the other hand, when an article is undergoing an austenitic carbonitriding treatment, the process is one that is almost entirely physical wherein molecules of carbon and nitrogen defuse into the surface of the metal without reacting chemically with the metal itself. Furthermore, ferritic nitro-carburizing treatments normally take place at temperatures below 600° C. while austenitic carbonitriding treatments normally take place at temperatures above 690° C. and preferably in the range of 820° C. to 950° C.

Blends, according to the present invention, were achieved utilizing bulk nitrogen, which is commercially available and which can be provided from a tank truck in liquid form and vaporized to a gas, standard gas cylinders either portable or in the form of tube trailers, and by nitrogen generating plants which produce nitrogen by liquefaction and fractionation of air; natural gas which is predominantly methane, commercially available carbon dioxide which can be obtained in bulk (liquid or gas) or cylinder form; and gaseous ammonia, also commercially available in a variety of known containers. The gaseous ingredients for the blend were piped from the storage receptacles to a multi-component gas blender designed by Air Products and Chemicals, Inc. to blend the gases used for the tests hereinafter described. Conventional blenders for combining gaseous components that are unreactive at ambient temperature can be used as is well known in the gas blending art.

The gaseous blends were injected into a production furnace according to techniques dictated by the particular furnace and the heat treating process being employed. Injecting of atmospheres into either batch or continuous furnaces is well known in the art and will vary depending on the size of the furnace and the particular heat treating process being employed.

Of particular interest, is the gas carburizing process developed as part of the instant invention.

In all of these processes, control of the carbon potential of the control atmosphere is essential if reliable and reproducible results are to be obtained: that is to say, in order to obtain or maintain a desired surface carbon content and desired carbon distribution in the steel.

The term "carbon potential" as used herein indicates the carbon content to which that gas will carburize steel if equilibrium is reached; it is customarily measured in percent of carbon in thin strips or shims of steel which have been brought to substantial equilibrium with the gas atmosphere and have a substantially uniform carbon content throughout. Thus, a gas having a carbon potential of 0.80 percent at T°C. would be in equilibrium with steel containing 0.80 percent of carbon at T°C. and would decarburize steel containing 0.90 percent of carbon at T°C. Carbon potential is a function of temperature, however, so that a gas having a carbon potential of 0.80 percent at T°C. would have carbon potential other than 0.80 at either a lower or a higher temperature.

In neutral heat treatment processes the carbon potential must be held equal to the carbon content of the metal surface.

By controlling the hydrocarbon/oxygen bearing medium ratio of the mixture, it is possible to regulate the carbon potential and thereby the migration of carbon as will be described hereinafter. Such control may be used to maintain the carbon potential fixed throughout the heat treatment period or to vary the carbon potential during the period. The latter type of control is useful for a technique which will be designated "layering in". This involves setting the carbon potential to an initial level to provide a desired case carbon content profile and then changing the level shortly before the end of the run to produce a desired carbon content, which may be higher or lower than that existing beforehand, at the metal surface. By this technique, it is possible to achieve almost any desired case carbon content profile.

Because of the buildup of residual carbon in the furnace walls, heating elements and work support, it is occasionally necessary to "regenerate" the furnace by burning out the residual carbon. The traditional method of doing this involves complete shutdown for an extended period. According to the present invention, in order to have less frequent periods of shutdown, the level of residual carbon can be reduced by running the furnace empty but with an input gas mixture containing a controlled amount of oxygen bearing medium which is greater than the amount required for stoichiometry with the hydrocarbon. This produces an excessively decarburizing atmosphere; the oxygen reacting directly or indirectly with the residual carbon. To do this with a conventional endothermic generator system would involve the provision of a supply of oxygen or air not required for normal operation, which is costly.

In an installation operating according to the method of this invention, it is simply necessary to adjust the amount of oxygen bearing medium in the mixture to effect a change in the characteristics of the furnace atmosphere.

In all the heat treatment processes mentioned above, there are five basic chemical reactions resulting from the introduction of the specified gas mixture into the furnace and these reactions are set out below:

$$\text{I.G.} + \text{H.C.} + (\text{O}) \rightarrow \text{CO} + \text{H}_2 + \text{I.G.} \quad (1)$$

where I.G. represents the inert gas; (O) represents the oxygen content of the oxygen bearing medium and H.C. represents the hydrocarbon.

In addition to the specified reaction products, there may also be traces of $CO_2$ and $H_2O$. This reaction is an irreversible partial combustion reaction. It is designated a partial combustion reaction because of the low oxygen ($O_2$) content relative to the hydrocarbon (H.C.) content. In fact, there is a considerable excess of hydrocarbon. The remaining reactions are:

$$\text{excess H.C.} \rightleftarrows \text{C} + \text{H}_2 \quad (2)$$

$$2\text{CO} \rightleftarrows \text{C}_{Fe} + \text{CO}_2 \quad (3)$$

where $C_{Fe}$ is the carbon content of the metal surface, $$\text{H}_2 + \text{CO} \rightleftarrows \text{H}_2\text{O} + \text{C}_{Fe} \quad (4)$$

$$\text{H}_2\text{O} + \text{CO} \rightleftarrows \text{CO}_2 + \text{H}_2 \quad (5)$$

Traditionally, the carburization process is considered to proceed in accordance with a forward movement (i.e. to the right) in reactions (2), (3) and (4) whereas the opposite is true for decarburization processes.

Reaction (5) indicates the tendency to equilibrium within the furnace chamber.

Generally speaking, to adjust the hydrocarbon/oxygen bearing medium ratio, is to adjust the carbon potential of the controlled atmosphere with the qualification that the hydrocarbon/oxygen bearing medium ratio is never adjusted to a level where the amount of hydrocarbon is less than that required for reaction (1). One exception is, however, the technique of furnace "regeneration" described above which requires an excessively decarburizing atmosphere, i.e. an oxygen-rich mixture.

It is preferred to use methane, in one form or another, as the hydrocarbon, but with hydrocarbons of any higher order, decomposition to carbon and methane will occur in addition to reaction (2). The hydrocarbon may be pure methane, a component of town's gas or any higher hydrocarbon. Conveniently, and for economic reason, the methane is introduced as a component of natural gas which is preferably present in an amount of between a trace and 40% by volume of the ingoing mixture, depending at least in part upon the heat treatment process concerned. Generally, lower hydrocarbon levels are used in neutral hardening and other neutral heat treatment processes.

The inert gas carrier may be any gas which is inert with respect to the five reactions mentioned above and which does not contain elements detrimental to the quality of the metal, for example, it may be helium or argon or any other of the Inert Gases. The cheapest and most readily available inert gas carrier is nitrogen. Molecular oxygen which may be introduced as a component of air, constitutes between 1.36% and 8.2% by volume of the mixture and, in its combined form, may be introduced as a constituent of water vapour or carbon dioxide. Whereas carbon dioxide ($CO_2$) is equivalent to $O_2$, 2.72% to 16.4% of water vapour is required to yield the equivalent oxygen content. It is preferred to use $CO_2$ as the oxygen bearing medium since this permits high surface carbon contents to be achieved with high nitrogen dilution, bearing in mind one of the desired objects, viz, to improve the safety of operation.

The elevated temperature referred to above depends upon the composition of the ferrous metal to be treated, but, will always be above the austenitic transformation temperature viz. above 690° C. for a simple iron-carbon alloy. In practice, the maximum temperature attained in the course of heat treatment would not exceed 1150° C., although it is conceivable that temperatures approaching the upper critical temperature and even the melting point of the metal concerned may be needed.

By way of example, the accompanying FIGURE schematically illustrates an embodiment of apparatus for preparing a mixture of gases required to produce the carbon controlled furnace atmosphere in-situ. Each inlet pipeline 10*a* to *d* is connected to a separate gas source. The pipeline 10*a* is for the inert gas carrier, in this example nitrogen, pipeline 10*b* is for the oxygen bearing medium in this example either air or carbon dioxide, and the pipeline 10*c* is for the hydrocarbon, in this example natural gas (methane). The pipeline 10*d* is only used in carbonitriding processes and is connected to a source of ammonia. Each pipeline includes a stop-valve 12*a* to 12*d*, a gas pressure control regulator, 14*a* to *d* and a non-return valve 20*a* to *d*. The four pipelines are connected to a common pipe 22, in which mixing of the various components occurs and which supplies the mixture to a conventional furnace. The furnance may be any one of the wide variety of furnaces known in the art utilizing controlled gas atmospheres. In the case of continuous furnaces, however, separate blending or mixing systems such as shown in the FIGURE may be used to introduce into different zones of the furnace mixtures of gas components which will react at the operating temperature of the furnace, to produce the different carbon potentials which may be required at certain stages of the heat treatment process.

The method of treating ferrous metal according to this invention and in particular the way in which the controlled furnace atmosphere is produced and regulated, is much simpler, more versatile, and less costly than conventional methods. Furthermore, the results which can be achieved are comparable with the known methods of heat treatment as illustrated by way of example in the carburizing tests results shown in Table I. In these tests, all of the steels used were case hardenable grade steels selected from E.N. 354, E.N. 35B, S.A.E. 8615/8617 and S.A.E. 8620, viz steels which would respond in a comparable manner to carburization. It should be noted that, in general, higher alloy steels require a longer time at the carburizing temperature in order to achieve the same depth of penetration and vice versa.

TABLE I

| Run No. | INGOING MIXTURE $N_2$ Flow % | N.G. Flow % | O.B.M. Flow (SCFH) | Total Flow (SCFH) | Nitrogen | Oxygen Cont. | NG: OBM Ratio | COMPOSITION-OUTLET, OF CONTROLLED ATMOSPHERE FURNACE (% by vol.) CO | $H_2$ | $CH_4$ | $N_2$ | Surface Carbon % | Case depth M.M. | Hardness Prior to Tempering Rc |
|---|---|---|---|---|---|---|---|---|---|---|---|---|---|---|
| 1 | 93 | 57 | 95(a) | | | | | | | | | | | |
| | 38% | 23.3% | 38.7% | 245 | 68.6% | 8.2% | 0.6 | 11.8% | 31.1% | 5.4% | 51.7% | 0.80 | 1.1 | 62 |
| 2 | 93 | 66 | 95 | | | | | | | | | | | |
| | 36.6% | 26.0% | 37.4%(a) | 254 | 66.1% | 7.9% | 0.7 | 11.6% | 32.1% | 6.9% | 49.4% | 0.88 | 1.1 | 62 |
| 3 | 100 | 76 | 95 | | | | | | | | | | | |
| | 36.9% | 28% | 35.1%(a) | 271 | 64.6% | 7.4% | 0.8 | 11.3% | 40.8% | 2.7% | 45.2% | 0.98 | 1.2 | 62 |
| 4 | 80 | 67 | 76 | | | | | | | | | | | |
| | 35.9% | 30.0% | 34.1%(a) | 223 | 62.8% | 7.2% | 0.9 | 11.3% | 41.0% | 2.5% | 45.2% | 1.11 | 1.0 | 64 |
| 5 | 177 | 37 | 31 | | | | | | | | | | | |
| | 72.2% | 15.1% | 12.7%(a) | 245 | 82.0% | 2.7% | 1.2 | 6.1% | 22.4% | 4.8% | 67.7% | 0.65 | 0.8 | 62 |
| 6 | 167 | 47 | 28 | | | | | | | | | | | |
| | 69.0% | 19.4% | 11.6%(a) | 242 | 78.1% | 2.4% | 1.7 | 6.5% | 26.5% | 5.8% | 61.2% | 0.73 | 0.8 | 62 |
| 7 | 150 | 57 | 28 | | | | | | | | | | | |
| | 61.0% | 23.2% | 11.4%(a) | 246 | 69.9% | 2.4% | 2.0 | 5.5% | 34.1% | 2.9% | 47.5% | 0.85 | 0.8 | 62 |
| 8 | 255 | 24 | 8 | | | | | | | | | | | |
| | 88.8% | 8.4% | 2.8%(b) | 287 | *N/A | N/A | 3.0 | 6.0% | 10.3% | 2.0% | 81.7% | 0.65 | 1.1 | 62 |
| 9 | 255 | 45 | 8 | | | | | | | | | | | |
| | 82.8% | 14.6% | 2.6%(b) | 308 | N/A | N/A | 5.6 | 4.7% | 18.3% | 2.0% | 75.0% | 0.86 | 1.1 | 64 |
| 10 | 255 | 38 | 6 | | | | | | | | | | | |
| | 85.3% | 12.7% | 2.0%(b) | 299 | N/A | N/A | 6.1 | 4.3% | 18.3% | 2.0% | 75.4% | 1.07 | 1.0 | 64 |

Notes:
*Not applicable
(a)air
(b)$CO_2$

The test results may be divided into three basic groups according to their nitrogen content; the first runs 1 to 4 being of the order of 60% to 70% by volume, the second runs 5 to 7 being of the order of 70% to 80% by volume and the third runs 8 to 10 being of the order of 80% to 90% by volume. The tests involved, in each run, raising the temperature of the furnace to 925° C. while, at the same time, passing the three component gaseous mixtures therethrough. After introducing the charge of steel components which caused a reduction in temperature to approximately 800° C., the temperature was allowed to recover. Following recovery, the furnace was maintained at 925° C. for a period of six hours during which the ingoing mixture was supplied at the rate specified in Table I. The temperature was then reduced to 850° C. before removal and quenching of the steel components. Quenching was effected in oil at a temperature of 110° C. The Rockwell hardness (Rc) and visual etched case depth were measured before tempering.

Table I gives the composition of the ingoing mixture both in terms of the flow rate setting of the valves 18*a* to *c* (see FIGURE) and as a percentage by volume of the mixture. These flow rates and the total flow rate of the ingoing mixture are given in standard cubic feet/hour (S.C.F.H.). In the Table, "N.G." refers to natural gas and "O.B.M." refers to the oxygen bearing medium which for runs 1 to 7 is air and for runs 8 to 10 is carbon dioxide.

For each of the three basic groups of tests, it can be seen that the amount of surface carbon is increased by increasing the N.G./O.B.M. ratio. The carbon content case profiles obtained compare favorably with those which could be achieved using traditional carburizing methods.

Table II is the log of a single test in which a batch of piston pins weighing 1600 lbs. and having a total surface area of approximately 300 ft.$^2$ were carburized. The pins were 2" outside diameter × 1" inside diameter × 6" long and were made of steel designated A.I.S.I. 8620. The object of the test was to achieve the following specification:

Surface hardness—56 to 62 Rc
Case
50 RC min, to a depth of 0.040" to 070"
0.070" to 0.100" total case depth
maximum—5% dispersed carbide
Core—25 to 42 Rc.

TABLE II

| Time hrs. mins. | Input Gas Flow (SCFH) $N_2$ | % $CH_4$ | $CO_2$ | Furnace Gas Analysis % $N_2$ | % $CH_4$ | % CO | % $H_2$ | Carbon Potential | Furn. Temp. °C. | Input $CH_4$: $CO_2$ Ratio | Remarks |
|---|---|---|---|---|---|---|---|---|---|---|---|
| 00.00 | 1000 | 124 | 15.5 | | | | | | | 8.0 | Load charged into furnace. |
| 1.00 | 560 | 124 | 15.5 | | | | | | | 8.0 | |
| 1.50 | 560 | 124 | 15.5 | | | | | | 927 | 8.0 | Furnace at 1700° F. |
| 1.57 | 560 | 124 | 15.5 | | | | | | 927 | 8.0 | |
| 3.03 | 560 | 124 | 15.5 | 70.5 | 5.7 | 3.9 | 19.9 | 1.50% | 927 | 8.0 | Shim stock weighed. |
| 3.45 | 560 | 117 | 23 | | | | | | 927 | 5.0 | Input $CH_4/CO_2$ Ratio reduced. |
| 4.15 | 560 | 117 | 23 | | | | | | 927 | 5.0 | |
| 4.55 | 560 | 117 | 23 | | | | | 1.37% | 927 | 5.0 | Shim stock weighed. |
| 5.40 | 560 | 117 | 23 | | | | | | 927 | 5.0 | |
| 6.25 | 560 | 117 | 23 | 70.2 | 5.3 | 5.8 | 18.8 | 1.32% | 927 | 5.0 | Shim stock weighed. |
| 6.45 | 560 | 107 | 33 | | | | | | 927 | 3.2 | Input $CH_4/CO_2$ Ratio. reduced. |
| 7.30 | 560 | 107 | 33 | | | | | 1.09% | 927 | 3.2 | Shim stock weighed. |
| 9.20 | 560 | 107 | 33 | 70.0 | 5.0 | 8.2 | 16.8 | 1.10% | 927 | 3.2 | Shim stock weighed. |
| 9.45 | 560 | 97 | 43 | | | | | | 927 | 2.3 | Input $CH_4/CO_2$ Ratio reduced. |
| 10.37 | 560 | 97 | 43 | | | | | .97% | 927 | 2.3 | Shim stock weighed. |
| 11.30 | 560 | 97 | 43 | | | | | .97% | 927 | 2.3 | |
| 11.55 | 560 | 97 | 43 | | | | | | 927 | 2.3 | |
| 12.05 | 560 | 97 | 43 | 69.6 | 4.3 | 10.7 | 15.4 | | 927 | 2.3 | |
| 12.25 | 560 | 97 | 43 | | | | | .95% | 927 | 2.3 | |
| 12.45 | 665 | 24 | 11 | | | | | | 927 | 2.2 | Nitrogen increases to 95%. |
| 12.53 | 665 | 24 | 11 | | | | | | 927 | 2.2 | Begin furnace cool to 843°C. |
| 13.08 | 665 | 24 | 11 | | | | | | 843 | 2.2 | Furnace at 843° C. |
| 13.22 | 665 | 24 | 11 | | | | | .68% | 843 | | |
| 14.00 | 665 | 24 | 11 | | | | | | 843 | 2.2 | Work load quenched in oil surface hardness as quenched -65 Rc. All parts tempered in air at 175° C. |

The laboratory test results performed on a sectioned part treated according to Table II indicated:

(a) Hardness
Surface hardness = 59 Rc
Core hardness = 28 Rc
(b) Mitallographic
Total case depth = 0.070"
Retained austenite (by point count) = 10%
No carbides or grain boundry oxides present
(c) Microhardness

| Depth Below Surface (inches) | Rockwell "C" Hardness | Remarks |
|---|---|---|
| .006 | 58 | |
| .010 | 58 | |
| .020 | 56 | |
| .030 | 54 | |
| .040 | 50 | Rc 50 min. |
| .050 | 46 | (to meet |
| .060 | 38 | specified |
| .100 | 29 | requirement) |
| .200 | 28 | |

In this test the oxygen bearing medium was carbon dioxide and the hydrocarbon was methane. By tracing the progress of the test of Table II it will be seen that by varying the $CH_4/CO_2$ ratio of the input mixture, variations in the carbon potential as measured by the well-known shim test can be achieved in order to meet a required heat treatment specification.

As examples of the application of the method of this invention to carbonitriding, the following tests were carried out:

Test I: An air motor cylinder of A.I.S.I. 8620 steel was treated with the object of obtaining a minimum carbonitrided case depth of 0.025". The time/temperature/atmosphere cycle was as set out below.

| Step | Gas Flow in SCFH $N_2$ | $CH_4$ | $CO_2$ | $NH_3$ | $CH_4$:$CO_2$ Ratio |
|---|---|---|---|---|---|
| 1. Heat up to 900° C. | 540 | | | | |
| 2. First 60 minutes at 900° C. | 460 | 67 | 13 | 40 | 5.1 |
| 3. Following 180 | 510 | 71 | 19 | 40 | 3.6 |

-continued

| Step | Gas Flow in SCFH $N_2$ | $CH_4$ | $CO_2$ | $NH_3$ | $CH_4$:$CO_2$ Ratio |
|---|---|---|---|---|---|
| minutes at 900° C. | | | | | |
| 4. Last 36 minutes at 900° C. | 540 | 45 | 15 | 20 | 3.0 |

After quenching in oil the resulting visual etched case depth was 0.032" and the surface hardness was 59Rc. The case profile was found to be:

| Depth | Rc Hardness |
|---|---|
| .006" | 57 |
| .010" | 58 |
| .020" | 54 |
| .030" | 51 |

Test II: A ball socket of A.I.S.I. 12L14 steel was treated with the object of obtaining a carbonitrided case depth of 0.003" to 0.005" and a surface which was file hard to Rc60.

| Step | Gas Flow in SCFH $N_2$ | $CH_4$ | $CO_2$ | $NH_3$ | $CH_4$:$CO_2$ Ratio |
|---|---|---|---|---|---|
| 1. Heat up to first 20 minutes at 871° C. | 540 | | | | |
| 2. Following 12 minutes at 871° C. | 480 | 103 | 17 | 40 | 6.1 |
| 3. Last 8 minutes at 871° C. | 540 | 48 | 12 | 20 | 4.0 |

After quenching in oil, the visual case depth was seen to be 0.005 to 0.006" and the surface was file hard to Rc60 as required.

The case profile was found to be:

| Depth | Rc Hardness |
|---|---|
| .002" | 60 |
| .004" | 54 |
| .006" | 37 |

The foregoing specification shows a process wherein the need for expensive generators to produce the endothermic gas is eliminated. A process has been demonstrated wherein standard industrial grade bulk nitrogen can be blended outside of a gas carburizing furnace with an oxygen bearing medium and a hydrocarbon. The mixture can be injected into a heat treating furnace wherein the mixture reacts to produce an effective carburizing atmosphere. As an added feature of the invention, a partial substitution of ammonia for the oxygen bearing medium and hydrocarbon can be effected to provide an effective carbonitriding atmosphere inside the furnace.

Furthermore, it should always be kept in mind that by blending known quantities of gas outside the furnace, more effective control of the carbon potential of the furnace atmosphere can be achieved, and thus, better control of the carburized case is facilitated.

Since endothermic gas is normally composed of 40% hydrogen, 20% carbon monoxide and 40% nitrogen, it is highly flammable and toxic. Blends according to the invention show a significant reduction of flammable hydrogen and toxic carbon monoxide. For example, if a mixture containing above 95% by volume nitrogen is used for neutral hardening, the mixture is non-flammable.

A series of tests were conducted using a mixture of nitrogen, propane, air and/or ammonia to provide an atmosphere during thermal treatment of ferrous metal parts. The tests were performed on parts supplied by a commercial heat treater. In most cases, the composition of the material was not specified. The heat treater only requested treatment continue until the parts met either a case depth or hardness specification. Set out in Table III is a summary of the results of these tests:

TABLE III

| Run No. | Treatment(1) | Material | Temp. °C. | Time(2) at Temp. | ATMOSPHERE GASES (FLOW-SCFH) $N_2$ | Propane | Air | $NH_3$ | Remarks |
|---|---|---|---|---|---|---|---|---|---|
| 113 | CH | Cutter Plates | 800° C. | 1 | 380 | 6 | 50 | — | Direct quench hardness-Rockwell C 60–63 (Parts-Clean) |
| 112 | C | 980 lb. load | 940° C. | 5 | 336 | 14 | 50 | — | Direct quench-effective Case Depth 0.044" |
| | | Bevel gears | 820° C. | 1 | 336 | 8 | 50 | — | *677 677 613 524 460 **.008 .018 .028 .038 .048 |
| 114 | CN | 200 pins and wedges | 870° C. | 2 5/6 | 330 | 8 | 25 | 30 | Direct quench-Hardness required 90 Rockwell-NT (Case) Result-93–95 Rockwell-NT (Case) |
| 115 | CN | Arms and shafts | 800° C. | 1 | 360 | 6 | 19 | 30 | Direct quench-surface-hardness 90–93 Rockwell NT |
| 117 | CN | Misc. hardware | 870° C. | 4 | 330 | 8 | 25 | 30 | Direct quench-surface hardness-63 Rockwell C Case depth - 0.003" |
| 119 | CN | Chime bars (850 lbs.) | 860° C. | 2 1/6 | 336 | 7/9 | 25 | 30 | Direct quench-surface hardness-92 Rockwell-NT Total case depth 0.020" |
| 124 | CN | Washers, gears, shafts | 880° C. | 3¾ | 260/ 300 | 13 — | 50 | 30/ 35 | Direct quench-Washers-Hardness 60–64 Rockwell C (0.0024" Case Depth) Samples EN36 Surface C 0.78% Samples EN32 Surface C 0.87% |
| 34 | CN | Misc. hardware | 880° C. | 2½ | 240 | 14 | 50 | 30 | Direct quench-load hardened |

TABLE III-continued

| Run No. | Treatment[1] | Material | Temp. °C. | Time[2] at Temp. | ATMOSPHERE GASES (FLOW-SCFH) $N_2$ | Propane | Air | $NH_3$ | Remarks |
|---|---|---|---|---|---|---|---|---|---|
| | | | | | | | | | and cleaned |
| 40 | C | Misc. hardware | 940° C. | 5½ | 340 | 14 | 50 | — | Direct quench-load hardened and cleaned |
| 133 | C | Mild steel | 950° C. | 2 1/6 | 250 | 40 | 50 | — | Atmosphere cool Case depth - 0.020" |

*Hardness-Vickers Number
**Case Depth in Inches
[1]CH = Clean Harder; C = Carburize; CN = Carbonitride
[2]Hours From the foregoing table it is apparent that propane is an effective source of hydrocarbon. Run 115 shows that (excluding $NH_3$ content) up to 98 gram moles nitrogen and as little as 1 gram mole of oxygen can be effectively utilized in mixtures of the present invention.

The existing processes can be adapted to existing furnaces with minimal capital investment. Overall process maintenance is simplified because no gas generator is required.

Lastly, with a blending panel and source of pure nitrogen, any furnace can be rapidly purged with an inert gas (nitrogen) thus making the overall process safer.

Having thus described my invention, what is claimed and desired to be secured by Letters Patent of the United States is set forth in the appended claims:

1. A method of heat treating a ferrous metal in a furnace chamber maintained at a temperature in excess of 690° C. and under a controlled atmosphere to effect a change in surface chemistry of the metal being treated comprising the steps of:

mixing at ambient temperature outside the furnace 35.9 to 72.2 percent by volume nitrogen, 15.1 to 30.0 percent by volume natural gas containing substantially methane and 11.4 to 38.7 percent by volume air with a natural gas to air ratio of from 0.6 to 2.0;

injecting said mixture into said furnace chamber whereby said mixture reacts under the influence of the temperature of the furnace chamber to produce a carbon controlled atmosphere inside said furnace chamber; and maintaining said furnace chamber temperature and continuing injection of said mixture for a time sufficient to achieve a change in the surface chemistry of the article being treated.

2. A method of heat treating a ferrous metal in a furnace chamber maintained at a temperature in excess of 690° C. and under a controlled atmosphere to effect carbonitriding of the metal being treated comprising the steps of:

charging the furnace with metal objects to be treated;

mixing at ambient temperature outside the furnace 71.9 to 86.7 percent by volume nitrogen, 1.5 to 4.2 percent by volume propane 4.6 to 14.9 percent by volume air and 7.2 to 9.0 percent by volume ammonia;

injecting said mixture into said furnace chamber whereby said mixture reacts under the influence of the temperature of the furnace chamber to produce a carbon-nitrogen controlled atmosphere inside said furnace chamber; and maintaining said furnace chamber temperature and continuing injection of said mixture for a time sufficient to achieve carbonitriding of the article being treated.

3. A method of heat treating a ferrous metal in a furnace chamber maintained at a temperature in excess of 690° C. and under a controlled atmosphere to carburize the metal being treated comprising the steps of:

charging the furnace with metal objects to be treated;

mixing outside the furnace 73.5 to 85.3 percent by volume nitrogen, 2.0 to 11.8 percent by volume propane, 12.4 to 14.7 percent by volume air with a propane to air ratio of from 0.16 to 0.8, and;

injecting said mixture into said furnace chamber whereby said mixture reacts under the influence of the temperature of the furnace chamber to produce a carbon controlled atmosphere inside said furnace chamber; and maintaining said furnace chamber temperature and continuing injection of said mixture for a time sufficient to carburize the article being treated.

* * * * *